US007518591B2

(12) United States Patent
Lin et al.

(10) Patent No.: US 7,518,591 B2
(45) Date of Patent: Apr. 14, 2009

(54) DRIVING METHOD FOR LIQUID CRYSTAL DISPLAY PANEL

(75) Inventors: Tung-Liang Lin, Hsinchu (TW); Sung-Kon Kim, Hsinchu (TW); Chien-Chia Shih, Hsinchu (TW)

(73) Assignee: Prime View International Co., Ltd., Hsinchu (TW)

( * ) Notice: Subject to any disclaimer, the term of this patent is extended or adjusted under 35 U.S.C. 154(b) by 631 days.

(21) Appl. No.: 11/214,707

(22) Filed: Aug. 29, 2005

(65) Prior Publication Data

US 2006/0267910 A1 Nov. 30, 2006

(30) Foreign Application Priority Data

May 30, 2005 (TW) ..... 94117617 A

(51) Int. Cl.
*G09G 3/36* (2006.01)

(52) U.S. Cl. ..... 345/100; 345/96; 345/209

(58) Field of Classification Search ..... 345/100, 345/87, 204, 690, 96, 94, 208, 209
See application file for complete search history.

(56) References Cited

U.S. PATENT DOCUMENTS 5,568,163 A * 10/1996 Okumura ..... 345/100
5,818,413 A * 10/1998 Hayashi et al. ..... 345/100
2001/0013852 A1* 8/2001 Matsushima et al. ..... 345/92

* cited by examiner

*Primary Examiner*—Amr Awad
*Assistant Examiner*—Stephen G Sherman
(74) *Attorney, Agent, or Firm*—Thomas, Kayden, Horstemeyer & Risley

(57) ABSTRACT

A driving method for a liquid crystal display (LCD) panel for displaying a frame having a first field and a second field on the LCD panel is provided. The driving method includes transmitting horizontal scan lines of the frame to the LCD panel using a line pair method and displaying the frame on the LCD panel using a column inversion method. Therefore, the driving method of the present invention can increase the resolution of the displayed frame without the need to provide additional memories or deploying complex algorithms.

6 Claims, 6 Drawing Sheets

| Scan line (Y) of LCD panel | |
|---|---|
| First frame | Second frame |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 11 | 11 |
| 12 | 12 |
| 13 | 13 |
| 14 | 14 |
| 15 | 15 |
| 16 | 16 |
| 17 | 17 |
| 18 | 18 |
| 19 | 19 |
| 20 | 20 |
| 21 | 21 |
| 22 | 22 |
| ⋮ | ⋮ |

| Horizontal scan line (Z) of TV signal | |
|---|---|
| Odd field | Even field |
| 1(*1) | 1 |
| 1 | 1 |
| 2 | 1 |
| 2 | 2 |
| 3 | 2 |
| 3(*1) | 3 |
| 4 | 3(*1) |
| 4 | 4 |
| 5 | 4 |
| 5 | 5 |
| 6 | 5 |
| 6(*1) | 6 |
| 7 | 6(*1) |
| 7 | 7 |
| 8 | 7 |
| 8 | 8 |
| 9 | 8 |
| 9(*1) | 9 |
| 10 | 9(*1) |
| 10 | 10 |
| 11 | 10 |
| 11 | 11 |
| 12 | 11 |
| 12(*1) | 12 |
| 13 | 12(*1) |
| 13 | 13 |
| 14 | 13 |
| ⋮ | ⋮ |

| Horizontal scan line (T) of TV signal | |
|---|---|
| Odd field | Even field |
| 1(*1) | 2 |
| 1 | 2 |
| 3 | 2 |
| 3 | 4 |
| 5 | 4 |
| 5(*1) | 6 |
| 7 | 6(*1) |
| 7 | 8 |
| 9 | 8 |
| 9 | 10 |
| 11 | 10 |
| 11(*1) | 12 |
| 13 | 12(*1) |
| 13 | 14 |
| 15 | 14 |
| 15 | 16 |
| 17 | 16 |
| 17(*1) | 18 |
| 19 | 18(*1) |
| 19 | 20 |
| 21 | 20 |
| 21 | 22 |
| 23 | 22 |
| 23(*1) | 24 |
| 25 | 24(*1) |
| 25 | 26 |
| 27 | 26 |
| ⋮ | ⋮ |

Odd field

| Y | T | 1 | 2 | 3 | 4 | 5 | 6 | ... | 299 | 300 |
|---|---|---|---|---|---|---|---|---|---|---|
| 1 | 1 | + | − | + | − | + | − | | + | − |
| 2 | 3 | + | − | + | − | + | − | ... | + | − |
| 3 | 5 | + | − | + | − | + | − | | + | − |
| 4 | 7 | + | − | + | − | + | − | | + | − |
| ⋮ | ⋮ | | | ⋮ | | | | | | ⋮ |
| 239 | 477 | + | − | + | − | + | − | ... | + | − |
| 240 | 479 | + | − | + | − | + | − | | + | − |

Even field

| Y | T | 1 | 2 | 3 | 4 | 5 | 6 | | 299 | 300 |
|---|---|---|---|---|---|---|---|---|---|---|
| 1 | 2 | − | + | − | + | − | + | | − | + |
| 2 | 4 | − | + | − | + | − | + | ... | − | + |
| 3 | 6 | − | + | − | + | − | + | | − | + |
| 4 | 8 | − | + | − | + | − | + | | − | + |
| ⋮ | ⋮ | | | ⋮ | | | | | | ⋮ |
| 239 | 478 | − | + | − | + | − | + | ... | − | + |
| 240 | 480 | − | + | − | + | − | + | | − | + |

FIG. 2 (PRIOR ART)

| Scan line (Y) of LCD panel | | Horizontal scan line (Z) of TV signal | | Horizontal scan line (T) of TV signal | |
|---|---|---|---|---|---|
| First frame | Second frame | Odd field | Even field | Odd field | Even field |
| 1 | 1 | 1 | 1 | 1 | 2 |
| 2 | 2 | 2 | 1 | 3 | 2 |
| 3 | 3 | 2 | 2 | 3 | 4 |
| 4 | 4 | 3 | 2 | 5 | 4 |
| 5 | 5 | 3 | 3 | 5 | 6 |
| 6 | 6 | 4 | 3 | 7 | 6 |
| 7 | 7 | 4 | 4 | 7 | 8 |
| 8 | 8 | 5 | 4 | 9 | 8 |
| 9 | 9 | 5 | 5 | 9 | 10 |
| ⋮ | ⋮ | ⋮ | ⋮ | ⋮ | ⋮ |
| 477 | 477 | 239 | 239 | 477 | 478 |
| 478 | 478 | 240 | 239 | 479 | 478 |
| 479 | 479 | 240 | 240 | 479 | 480 |
| 480 | 480 | 241 | 240 | 481 | 480 |

FIG. 3A

| Scan line (Y) of LCD panel | |
|---|---|
| First frame | Second frame |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| ⋮ | ⋮ |
| 477 | 477 |
| 478 | 478 |
| 479 | 479 |
| 480 | 480 |

| Horizontal scan line (Z) of TV signal | |
|---|---|
| Odd field | Even field |
| 1 | 1 |
| 1 | 2 |
| 2 | 2 |
| 2 | 3 |
| 3 | 3 |
| 3 | 4 |
| 4 | 4 |
| 4 | 5 |
| 5 | 5 |
| ⋮ | ⋮ |
| 239 | 239 |
| 239 | 240 |
| 240 | 240 |
| 240 | 241 |

| Horizontal scan line (T) of TV signal | |
|---|---|
| Odd field | Even field |
| 1 | 2 |
| 1 | 4 |
| 3 | 4 |
| 3 | 6 |
| 5 | 6 |
| 5 | 8 |
| 7 | 8 |
| 7 | 10 |
| 9 | 10 |
| ⋮ | ⋮ |
| 477 | 478 |
| 477 | 480 |
| 479 | 480 |
| 479 | 482 |

FIG. 3B

| Scan line (Y) of LCD panel | |
|---|---|
| First frame | Second frame |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 11 | 11 |
| 12 | 12 |
| 13 | 13 |
| 14 | 14 |
| 15 | 15 |
| 16 | 16 |
| 17 | 17 |
| 18 | 18 |
| 19 | 19 |
| 20 | 20 |
| 21 | 21 |
| 22 | 22 |
| ⋮ | ⋮ |

| Horizontal scan line (Z) of TV signal | |
|---|---|
| Odd field | Even field |
| 1(*1) | 1 |
| 1 | 1 |
| 2 | 1 |
| 2 | 2 |
| 3 | 2 |
| 3(*1) | 3 |
| 4 | 3(*1) |
| 4 | 4 |
| 5 | 4 |
| 5 | 5 |
| 6 | 5 |
| 6(*1) | 6 |
| 7 | 6(*1) |
| 7 | 7 |
| 8 | 7 |
| 8 | 8 |
| 9 | 8 |
| 9(*1) | 9 |
| 10 | 9(*1) |
| 10 | 10 |
| 11 | 10 |
| 11 | 11 |
| 12 | 11 |
| 12(*1) | 12 |
| 13 | 12(*1) |
| 13 | 13 |
| 14 | 13 |
| ⋮ | ⋮ |

| Horizontal scan line (T) of TV signal | |
|---|---|
| Odd field | Even field |
| 1(*1) | 2 |
| 1 | 2 |
| 3 | 2 |
| 3 | 4 |
| 5 | 4 |
| 5(*1) | 6 |
| 7 | 6(*1) |
| 7 | 8 |
| 9 | 8 |
| 9 | 10 |
| 11 | 10 |
| 11(*1) | 12 |
| 13 | 12(*1) |
| 13 | 14 |
| 15 | 14 |
| 15 | 16 |
| 17 | 16 |
| 17(*1) | 18 |
| 19 | 18(*1) |
| 19 | 20 |
| 21 | 20 |
| 21 | 22 |
| 23 | 22 |
| 23(*1) | 24 |
| 25 | 24(*1) |
| 25 | 26 |
| 27 | 26 |
| ⋮ | ⋮ |

FIG. 4

| Scan line (Y) of LCD panel | |
|---|---|
| First frame | Second frame |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 11 | 11 |
| 12 | 12 |
| 13 | 13 |
| 14 | 14 |
| 15 | 15 |
| 16 | 16 |
| 17 | 17 |
| 18 | 18 |
| 19 | 19 |
| 20 | 20 |
| 21 | 21 |
| 22 | 22 |
| ⋮ | ⋮ |

| Horizontal scan line (Z) of TV signal | |
|---|---|
| Odd field | Even field |
| 1(*1) | |
| 1 | 1 |
| 2 | 1 |
| 2 | 2 |
| 3(*2) | |
| 4 | 2 |
| 4 | 3 |
| 5 | 3 |
| 4(*2) | |
| 5 | 5 |
| 6 | 5 |
| 6 | 6 |
| 7 | 6 |
| 7 | 7 |
| 8 | 7 |
| 8 | 8 |
| 9(*2) | |
| 10 | 8 |
| 10 | 9 |
| 11 | 9 |
| 10(*2) | |
| 11 | 11 |
| 12 | 11 |
| 12 | 12 |
| 13 | 12 |
| 13 | 13 |
| 14 | 13 |
| ⋮ | ⋮ |

| Horizontal scan line (T) of TV signal | |
|---|---|
| Odd field | Even field |
| 1(*1) | |
| 1 | 2 |
| 3 | 2 |
| 3 | 4 |
| 5(*2) | |
| 7 | 4 |
| 7 | 6 |
| 9 | 6 |
| 8(*2) | |
| 9 | 10 |
| 11 | 10 |
| 11 | 12 |
| 13 | 12 |
| 13 | 14 |
| 15 | 14 |
| 15 | 16 |
| 17(*2) | |
| 19 | 16 |
| 19 | 18 |
| 21 | 18 |
| 20(*2) | |
| 21 | 22 |
| 23 | 22 |
| 23 | 24 |
| 25 | 24 |
| 25 | 26 |
| 27 | 26 |
| ⋮ | ⋮ |

FIG. 5

DRIVING METHOD FOR LIQUID CRYSTAL DISPLAY PANEL

CROSS-REFERENCE TO RELATED APPLICATION

This application claims the priority benefit of Taiwan application serial no. 94117617, filed on May 30, 2005. All disclosure of the Taiwan application is incorporated herein by reference.

BACKGROUND OF THE INVENTION

1. Field of the Invention

The present invention relates to a driving method for a liquid crystal display (LCD) panel. More particularly, the present invention relates to a driving method for an LCD panel for displaying a television (TV) signal.

2. Description of the Related Art

A TV signal is generally displayed in an interlacing method such that each frame of the TV signal has an odd field and an even field. In the TV signal, the scan lines of a field (e.g. an odd field) are interlaced between the scan lines of another field (e.g. an even field).

FIG. 1 is a diagram showing an interlacing TV signal. As shown in FIG. 1, using NTSC TV system as an example, a frame has altogether 525 scan lines. Nevertheless, after deducting the scan lines for flyback, the number of the remaining scan lines which are effective is 484. The effective scan lines are labeled 1, 2, 3, . . . , 482, 483 and 484 respectively. Further, a frame is built by an odd field and an even field. The odd field includes the scan lines labeled 1, 3, 5, . . . , 481 and 483 while the even field includes the scan lines labeled 2, 4, 6, . . . , 482 and 484. Furthermore, other TV systems such as PAL are similar to NTSC.

FIG. 2 is a diagram showing the TV signal displayed through an LCD. In practice, the driving method for the display panel of the LCD includes enabling each scan line of the LCD panel and transmitting corresponding data through data lines of the LCD panel when a particular scan line is activated. The corresponding data can be the data contained in one effective scan line of either the odd field or the even field. Therefore, the data in one of the effective scan lines (non-physical) of either the odd field or the even field is called 'horizontal scan line', which is to distinguish it from one of the scan lines (physical) of the LCD panel.

As shown in FIG. 2, the letters X and Y represent the label sets of the data lines and the scan lines of the LCD panel respectively. The letter T represents the label set of the horizontal scan lines of the TV signal. When an LCD panel having 240 scan lines is used to display a frame having 484 horizontal scan lines (that is, each of the odd and the even field has 242 horizontal scan lines), the odd and the even field of each frame are displayed in an interlacing method. For example, on the LCD panel, the odd field of a first frame is displayed and then followed by displaying the even field of the first frame. Then, the odd field of a second frame is displayed and then followed by displaying the even field of the second frame. In this way, the odd field and the even field of each frame are displayed alternately.

Obviously, displaying the 242 horizontal scan lines of an odd field (or an even field) on the LCD panel having 240 scan lines cannot escape losing two horizontal scan lines. In general, the first and the last horizontal scan lines are discarded or some other scheme is used without much effect on the entire frame. To prevent the unidirectional application of an electric field on the liquid crystals that may lead to a deterioration of the twisting property of the liquid crystal, the liquid crystals are alternately driven through a polarity inversion driving method. For example, FIG. 2 shows the column inversion which is one of the polarity inversion driving methods. Other types of the polarity inversion driving methods include row inversion, frame inversion and dot inversion.

In the conventional technique, if an LCD panel having 240 scan lines is used to display an TV signal comprising an odd field and an even field each having 242 horizontal scan lines, the maximum resolution of the displayed frame is only 240 scan lines. To increase the resolution, the number of scan lines of the LCD panel must be increased, for example, to 480 scan lines. Thus, there is a need to provide additional memories to store the previous field (having 242 horizontal scan lines) so that it can match with the next field (having 242 horizontal scan lines) so to display together on the LCD panel (having 480 scan lines). Alternatively, some memories together with sophisticated algorithms can be used to provide the resolution higher than the 480 scan lines of the LCD panel (having 480 scan lines).

SUMMARY OF THE INVENTION

Accordingly, at least one objective of the present invention is to provide a driving method for an LCD panel so that the resolution of displayed frames is increased without the need for providing additional memories or using sophisticated algorithms.

To achieve these and other advantages and in accordance with the purpose of the invention, as embodied and broadly described herein, the invention provides a driving method for an LCD panel for displaying a frame on the LCD panel. The LCD panel has M scan lines and N data lines. The frame includes a first field and a second field. Each of the first and the second field includes L horizontal scan lines. The driving method includes sequentially receiving and transmitting the horizontal scan lines of the first field to the LCD panel to display the first field on the LCD panel; and sequentially receiving and transmitting the horizontal scan lines of the second field to the LCD panel to display the second field on the LCD panel thereafter.

When the first field is displayed on the LCD panel, P of the horizontal scan lines of the first field are transmitted to two consecutive scan lines of the LCD panel respectively, and Q of the horizontal scan lines are transmitted to one scan line of the LCD panel respectively. Furthermore, the order of any two of the horizontal scan lines transmitted to the LCD panel is identical to the order of any two of horizontal scan lines of the first field. Meanwhile, the signal polarity of odd-numbered data lines of the data lines and the signal polarity of even-numbered data lines of the data lines of the LCD panel are a first polarity and a second polarity respectively.

When the second field is displayed on the LCD panel, R of the horizontal scan lines of the second field are transmitted to two consecutive scan lines of the LCD panel respectively, and S of the horizontal scan lines are transmitted to one scan line of the LCD panel respectively. Furthermore, the order of any two of the horizontal scan lines transmitted to the LCD panel is identical to the order of any two of the horizontal scan lines of the second field. Meanwhile, the signal polarity of the odd-numbered data lines of the data lines and the signal polarity of the even-numbered data lines of the data lines of the LCD panel are the second polarity and the first polarity respectively.

Wherein, L, M, N, P and R are natural numbers, Q and S are non-negative integers, $P+Q \leqq L$ and $R+S \leqq L$. In addition, the first polarity and the second polarity represent the voltage level of the input signal at one of the data lines relative to the common electrode on the upper substrate. In the present embodiment, the first polarity and the second polarity are two reverse polarities. For example, if the first polarity has a positive value, the second polarity has a negative value. The odd-numbered data lines have positive values (the even-numbered data lines of the first field have negative values) when the first field is displayed and the odd-numbered data lines have negative values (the even-numbered data lines of the second field have positive values) when the second field is displayed. In other words, the column inversion of the polarity inversion driving method is used.

It should be noted that in the prior technique shown in FIG. 1 the horizontal scan lines of the odd field are labeled 1, 3, 5, . . . , 2n−1 and the horizontal scan lines of the even field are labeled 2, 4, 6, . . . , 2n where n is a positive integer. However, to systematize the explanation in the present invention, the horizontal scan lines of both the odd field and the even field are labeled using 1, 2, 3, . . . , n and so on. Therefore, the first, the second, the third horizontal scan lines of the odd field are equivalent to the first, the third and the fifth horizontal scan lines respectively in FIG. 1. Similarly, the first, the second and the third horizontal scan lines of the even field are equivalent to the second, the fourth and the sixth horizontal scan lines respectively in FIG. 1 and so on.

In one embodiment, $P+Q=R+S=L$, where $Q\neq 0$ and $S\neq 0$. Therefore, a few of the horizontal scan lines of the first field (and the second field) are transmitted to two consecutive scan lines of the LCD panel respectively while the remaining of the horizontal scan lines of the first field (or the second field) are transmitted to one scan line of the LCD panel respectively. In another embodiment, $P+Q<L$, $R+S<L$, $Q\neq 0$ and $S\neq 0$. Therefore, a few of the horizontal scan lines of the first field (or the second field) are transmitted to two consecutive scan lines of the LCD panel respectively while some of the remaining of the horizontal scan lines are transmitted to one scan lines of the LCD panel respectively. In these two embodiments, when the first field is displayed, the $h^{th}$ horizontal scan line of the first field is transmitted to the $g^{th}$ scan line of the LCD panel. On the other hand, when the second field is displayed, either one of the $(h-1)^{th}$, the $h^{th}$ and the $(h+1)^{th}$ horizontal scan lines is transmitted to the $g^{th}$ scan line of the LCD panel. Here, h and g are natural numbers such that $h\leqq L$ and $g\leqq M$. Both embodiments are applicable when the horizontal scan lines of the first field (or the second field) are driven by a line pair driving method and the number of the horizontal scan lines is larger than the number of the scan lines of the LCD panel.

In brief, the driving method for the LCD panel according to the present invention utilizes the line pair driving method to transmit the horizontal scan lines of the frame to the LCD panel and the column inversion driving method to display the frame on the LCD panel. Hence, the resolution of the frame can be increased without the need to provide additional memories or use sophisticated algorithms.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 2 is a diagram showing the interlacing TV signal displayed through an LCD.

FIGS. 3A and 3B are diagrams showing driving methods for an LCD panel according to one preferred embodiment of the present invention.

FIG. 4 is a diagram showing a driving method for an LCD panel according to another preferred embodiment of the present invention.

FIG. 5 is a diagram showing a driving method for an LCD panel according to yet another preferred embodiment of the present invention.

DESCRIPTION OF THE PREFERRED EMBODIMENTS

Figure 1:
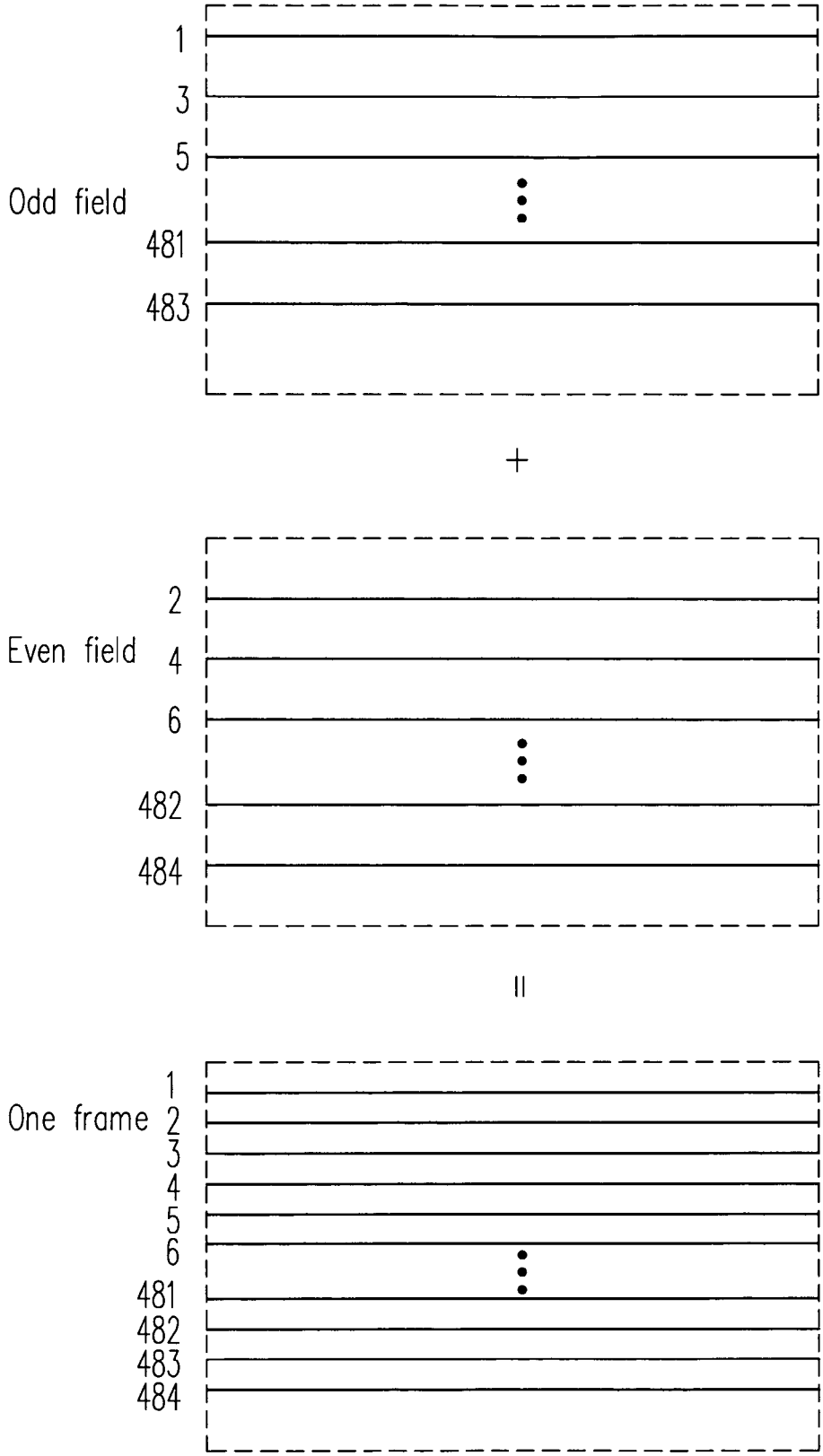
FIG. 1 (PRIOR ART)
FIG. 1 is a diagram showing an interlacing TV signal.

Reference will now be made in detail to the present preferred embodiments of the invention, examples of which are illustrated in the accompanying drawings. Wherever possible, the same reference numbers are used in the drawings and the description to refer to the same or like parts.

To explain the embodiment of the present invention more clearly, the first field and the second field in the following description are an odd field and an even field and the first polarity and the second polarity are a positive value and a negative value respectively.

FIGS. 3A and 3B are diagrams showing driving methods for an LCD panel according to one preferred embodiment of the present invention. The method is particularly suitable when the horizontal scan lines of the odd field (or the even field) are driven by a line pair driving method and the number of the horizontal scan lines is equal to the number of the scan lines of the LCD panel.

As shown in FIG. 3A, the rightmost diagram with the heading 'Horizontal scan line (T) of TV signal' and the middle diagram with the heading 'Horizontal scan line (Z) of TV signal' are intrinsically the same frame. The former horizontal scan lines are labeled using the labeling method in FIG. 1 and the latter horizontal scan lines are labeled using the labeling method according to the present invention. Similarly, as shown in FIG. 3B, the rightmost diagram with the heading 'Horizontal scan line (T) of TV signal' and the middle diagram with the heading 'Horizontal scan line (Z) of TV signal' are intrinsically the same frame. The TV signal are displayed in an interlacing method; for example, the TV signal is specified by NTSC or PAL.

To facilitate the explanation, the letters Y, Z and T in the description will represent 'Scan line (Y) of LCD panel', 'Horizontal scan line (Z) of TV signal' and 'Horizontal scan line (T) of TV signal' respectively.

As shown in FIGS. 3A and 3B, the LCD receives the interlacing TV signal similar to that shown in FIG. 1. Each frame of the TV signal includes an odd field and an even field. Each of the odd field and the even field comprises L horizontal scan lines (L is 242, for example). In FIG. 3A, only one representative frame (the Z or T) is shown. However, anyone familiar with the technique will notice that the driving method in the present invention aims at each frame of the interlacing TV signal. Because the present invention uses a line pair driving method to drive the LCD, the display panel of the LCD at least requires M scan lines and N data lines. Here, $M<2L$. In the following description, $M=480$ and $L=242$ are used as an example.

The so-called 'line pair' driving refers to the transmission of each horizontal scan line of the odd field or the even field to two consecutive scan lines of the LCD panel. Furthermore, the order of any two of the horizontal scan lines transmitted to the LCD panel is identical to the order of any two of the horizontal scan lines of the first field. For example, one frame of the original TV signal includes the horizontal scan lines {1, 2, 3, 4, 5, 6, 7, 8, 9, 10, 11, 12, . . . }. Therefore, the odd field includes the horizontal scan lines {1, 3, 5, 7, 9, 11, . . . } and the even field includes the horizontal scan lines {2, 4, 6, 8, 10, 12, . . . }. The horizontal scan lines {a, b, c} represent an ordering relation of the $a^{th}$, the $b^{th}$ and the $c^{th}$ horizontal scan lines. The horizontal scan lines {1, 3, 5, 7, 9, 11, . . . } become {1, 1, 3, 3, 5, 5, . . . } after the horizontal scan lines are converted into line pairs. Similarly, the horizontal scan lines {2, 4, 6, 8, 10, 12, . . . } become {2, 2, 4, 4, 6, 6, . . . } after the horizontal scan lines are converted into line pairs.

However, in order to improve the resolution of the displayed frame, the scan lines at both sides should be staggered, such as 'T' shown in FIG. 3A. The horizontal scan lines of the odd field become {1, 3, 3, 5, 5, 7, . . . } while the horizontal scan lines of the even field remain unchanged as {2, 2, 4, 4, 6, 6, . . . }. Thus, the first horizontal scan line do not use line pair method. Alternatively, as 'T' shown in FIG. 3B, the horizontal scan lines of the odd field are to be kept unchanged as {1, 1, 3, 3, 5, 5, . . . } while the horizontal scan lines of the even field become {2, 4, 4, 6, 6, 8, . . . }.

The driving method of the present invention can be explained in another way using the Z in FIG. 3A. When a frame (including the odd field and the even field of Z) of a TV signal is displayed, first the odd field of Z is displayed on the first frame of the LCD panel. Then, the even field of Z is displayed on the second frame of the LCD panel. The first and the second frames are actually the displayed frame on the same display panel but at a different time. Hence, the first and the second frames have the same scan line label.

When the odd field of Z is displayed on the LCD panel (or the first frame), the first horizontal scan line of the odd field of Z is transmitted to the first scan line of the LCD panel (or the first frame) and the $j^{th}$ horizontal scan line of the odd field of Z is transmitted to the $(2j-2)^{th}$ and the $(2j-1)^{th}$ scan lines (here, j=2, 3, . . . , 239; in other words, j is a natural number and $1<j\leqq L$) of the LCD panel (or the first frame), and the $241^{st}$ horizontal scan line of the odd field of Z is transmitted to the $480^{th}$ ($M^{th}$) scan line of the LCD panel (or the first frame). When the even field of Z is displayed on the LCD panel (or the second frame), the $i^{th}$ horizontal scan line of the even field of Z is transmitted to the $(2i-1)^{th}$ and the $2i^{th}$ scan lines (here, i=1, 2, 3, . . . , 240; in other words, i is a natural number and i<L) of the LCD panel (or the second frame).

In FIGS. 3A and 3B, the diagram on the left with the heading Y lists out the scan line labels of the LCD panel but without the data line labels. However, the driving method of the present invention still needs to match up with the polarity inversion driving method described in FIG. 2 to prevent any deterioration of the liquid crystal twisting property. The present invention uses a line pair driving method. Furthermore, the polarity inversion of the LCD panel uses a column inversion driving method.

FIG. 4 is a diagram showing a driving method for an LCD panel according to another preferred embodiment of the present invention. The present method is particularly suitable when the horizontal scan lines of the odd field (or the even field) are driven in line pairs and the number of horizontal scan lines is greater than the number of scan lines of the LCD panel. For example, if each of the odd field and the even field has L horizontal scan lines (for example, 286 horizontal scan lines), then each has 2L horizontal scan lines (for example, 572 horizontal scan lines) after the line pair driving. However, the LCD panel has only M scan lines (for example, 468 scan lines).

As shown in FIG. 4, the driving method of the present invention includes transmitting P of the horizontal scan lines of the odd field and the even field to two consecutive scan lines of the LCD panel respectively. The remaining Q horizontal scan lines are transmitted to one scan line of the LCD panel respectively. Here, P+Q=L, and P, Q, L are natural numbers. Then, the odd field and the even field are displayed on the LCD panel. It should be noted that the labels bracketed by dotted lines represent the horizontal scan lines with respect to the labels do not use line pairs and (*1) represents the condition that there is one less line after using the line pair method.

For example, the odd field of Z in FIG. 4 includes the horizontal scan lines {1, 2, 2, 3, 4, 4, 5, 5, 6, 7, 7, 8, 8, 9, 10, 10, . . . }. It shows that the horizontal scan lines {2, 4, 5, 7, 8, 10, 11, 13, . . . } of the horizontal scan lines {1, 2, 3, 4, 5, 6, 7, 8, 9, 10, 11, 12, . . . } included in one frame of the original TV signal are transmitted to two consecutive scan lines of the LCD panel respectively. The remaining horizontal scan lines {1, 3, 6, 9, 12, . . . } are transmitted to one scan line of the LCD panel respectively. Similarly, the even field of Z in FIG. 4 includes the horizontal scan lines {1, 1, 2, 2, 3, 4, 4, 5, 5, 6, 7, 7, 8, 8, 9, . . . }. It shows that the horizontal scan lines {1, 2, 4, 5, 7, 8, 10, 11, 13, . . . } of the horizontal scan lines {1, 2, 3, 4, 5, 6, 7, 8, 9, 10, 11, 12, . . . } included in one frame of the original TV signal are transmitted to two consecutive scan lines of the LCD panel respectively. The remaining horizontal scan line {3, 6, 9, 12, . . . } are transmitted to one scan line of the LCD panel respectively.

FIG. 5 is a diagram showing a driving method for an LCD panel according to yet another preferred embodiment of the present invention. The condition of applicability is similar to the one in FIG. 4. As shown in FIG. 5, the driving method of the present invention includes transmitting P of the horizontal scan lines of the odd field and the even field to two consecutive scan lines of the LCD panel respectively. The remaining Q horizontal scan lines are transmitted to one scan line of the LCD panel respectively. Here, P+Q<L, and P, Q, L are natural numbers. Then, the odd field and the even field are displayed on the LCD panel. It should be noted that the labels bracketed by dotted lines represent the horizontal scan lines with respect to the labels do not use line pairs and (*2) represents the condition that there are two less lines after using the line pair method. It means that the horizontal scan lines with respect to the labels are not displayed.

For example, the odd field of Z in FIG. 5 includes the horizontal scan lines {1, 2, 2, 4, 4, 5, 5, 6, 6, 7, 7, 8, 8, 10, 10, . . . }. It shows that the horizontal scan lines {2, 4, 5, 6, 7, 8, 10, 11, . . . } of the horizontal scan lines {1, 2, 3, 4, 5, 6, 7, 8, 9, 10, 11, 12, . . . } included in one frame of the original TV signal are transmitted to two consecutive scan lines of the LCD panel respectively. The first horizontal scan line is transmitted to one scan line of the LCD panel while the horizontal scan lines {3, 9, 15, 21, . . . } are not transmitted. Similarly, the even field of Z in FIG. 5 includes the horizontal scan lines {1, 1, 2, 2, 3, 3, 5, 5, 6, 6, 7, 7, 8, 8, 9, 9, 11, 11, . . . }. It shows that the horizontal scan lines {1, 2, 3, 5, 6, 7, 8, 9, 11, 12, . . . } of the horizontal scan lines {1, 2, 3, 4, 5, 6, 7, 8, 9, 10, 11, 12, . . . } included in one frame of the original TV signal are transmitted to two consecutive scan lines of the LCD panel. The horizontal scan lines {4, 10, 16, 22, . . . } are transmitted to one scan line of the LCD panel.

In the driving method described in FIGS. 4 and 5, which horizontal scan line is transmitted to two consecutive scan lines of the LCD panel; which horizontal scan line is transmitted to one scan line of the LCD panel; and which horizontal scan line is not transmitted; can be decided in many ways as long as the following conditions are met. The conditions include: the $h^{th}$ horizontal scan line of the odd field is transmitted to the $g^{th}$ scan line of the LCD panel when the odd field is displayed, and one of the $(h-1)^{th}$, the $h^{th}$ and the $(h+1)^{th}$ horizontal scan lines is transmitted to the $g^{th}$ scan line of the LCD panel when the even field is displayed, wherein h and g are natural numbers with $h \leqq L$ and $g \leqq M$.

It should be noted that each horizontal scan line is shown on at least a scan line of the LCD panel in the driving method described in FIG. 4. However, a portion of the horizontal scan lines is not shown on the LCD panel in the driving method described in FIG. 5. Hence, the resolution of the driving method described in FIG. 5 is lower than the one described in FIG. 4.

In summary, the driving method for the LCD panel according to the present invention utilizes the line pair driving method to transmit the horizontal scan lines of a frame to the LCD panel and the column inversion driving method to display the frame on the LCD panel. Hence, the resolution of the frame can be increased without the need to provide additional memories or use sophisticated algorithms.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving method for a liquid crystal display (LCD) panel for displaying a frame having a first field and a second field on the LCD panel such that each of the first field and the second field includes L horizontal scan lines, wherein the LCD panel includes M scan lines and N data lines, the driving method comprising:

sequentially receiving the horizontal scan lines of the first field and transmitting the horizontal scan lines of the first field to the LCD panel for displaying the first field; wherein each of P of the horizontal scan lines of the first field is transmitted to two consecutive scan lines of the LCD panel respectively, and each of Q of the horizontal scan lines is transmitted to only one scan line of the LCD panel; and furthermore, the order of any two of the horizontal scan lines transmitted to the LCD panel is identical to the order of any two of the horizontal scan lines of the first field; and moreover, the signal polarity of odd-numbered data lines of the data lines and the signal polarity of even-numbered data lines of the data lines of the LCD panel are a first polarity and a second polarity respectively; and sequentially receiving the horizontal scan lines of the second field and transmitting the horizontal scan lines of the second field to the LCD panel for displaying the second field; wherein each of R of the horizontal scan lines of the second field is transmitted to two consecutive scan lines of the LCD panel respectively, and each of S of the horizontal scan lines is transmitted to only one scan line of the LCD panel; and furthermore, the order of any two of the horizontal scan lines transmitted to the LCD panel is identical to the order of any two of the horizontal scan lines of the second field; and moreover, the signal polarity of the odd-numbered data lines of the data lines and the signal polarity of the even-numbered data lines of the data lines of the LCD panel are the second polarity and the first polarity respectively;

wherein the first polarity and the second polarity are opposite polarity; L, M, N, P and R are natural numbers; Q and S are non-negative integers; $P+Q \leqq L$; and $R+S \leqq L$, wherein $Q>1$ and $S>1$; the $h^{th}$ horizontal scan line of the first field is transmitted to the $g^{th}$ scan line of the LCD panel; and one of the $(k-1)^{th}$, the $k^{th}$ and the $(k+1)^{th}$ horizontal scan lines of the second field is transmitted to the $g^{th}$ scan line of the LCD panel; wherein h and g are natural numbers, $h \leqq Q$, $k \leqq S$ and $g \leqq M$.

2. The driving method for the LCD panel of claim 1, wherein $P+Q=L$, and $R+S=L$.

3. The driving method for the LCD panel of claim 2, wherein $P=M-L$, and $Q=2L-M$.

4. The driving method for the LCD panel of claim 1, wherein the first polarity has a positive value and the second polarity has a negative value.

5. The driving method for the LCD panel of claim 1, wherein the first polarity has a negative value and the second polarity has a positive value.

6. The driving method for the LCD panel of claim 1, wherein $P+Q<L$, and $R+S<L$.

* * * * *